US005322117A

United States Patent [19]

Guetersloh et al.

[11] Patent Number: 5,322,117

[45] Date of Patent: Jun. 21, 1994

[54] HEAT EXCHANGER MEDIA FRAME

[75] Inventors: Timothy L. Guetersloh, Deerfield; Gary A. Essmann, Brookfield, both of Wis.

[73] Assignee: Research Products Corporation, Madison, Wis.

[21] Appl. No.: 55,228

[22] Filed: Apr. 28, 1993

[51] Int. Cl.[5] ..... F28D 9/02

[52] U.S. Cl. ..... 165/166; 165/82

[58] Field of Search ..... 165/82, 166

[56] References Cited

U.S. PATENT DOCUMENTS 4,596,285 6/1986 Dimlesca ..... 165/166 X 4,805,695 2/1989 Ishikawa et al. ..... 165/166

*Primary Examiner*—John C. Fox

*Attorney, Agent, or Firm*—Andrus, Sceales, Starke & Sawall

[57] ABSTRACT

A corner frame construction for a heat exchanger includes an elongated L-shaped member disposed between the top and bottom plates of the heat exchanger. The L-shaped member has a first leg extending parallel to a first edge of the media layers and a second leg extending perpendicular to the first leg and parallel to a second edge of the media layers. A first flange is connected to the first leg and extends inwardly toward the edge of the media layer and a second flange is connected to the second leg and extends inwardly toward a second edge of the media layer. A layer of flowable sealant is disposed along the length of the L-shaped member and is contact with both the first and second legs, the first and second media edges and the first and second flange members.

2 Claims, 1 Drawing Sheet

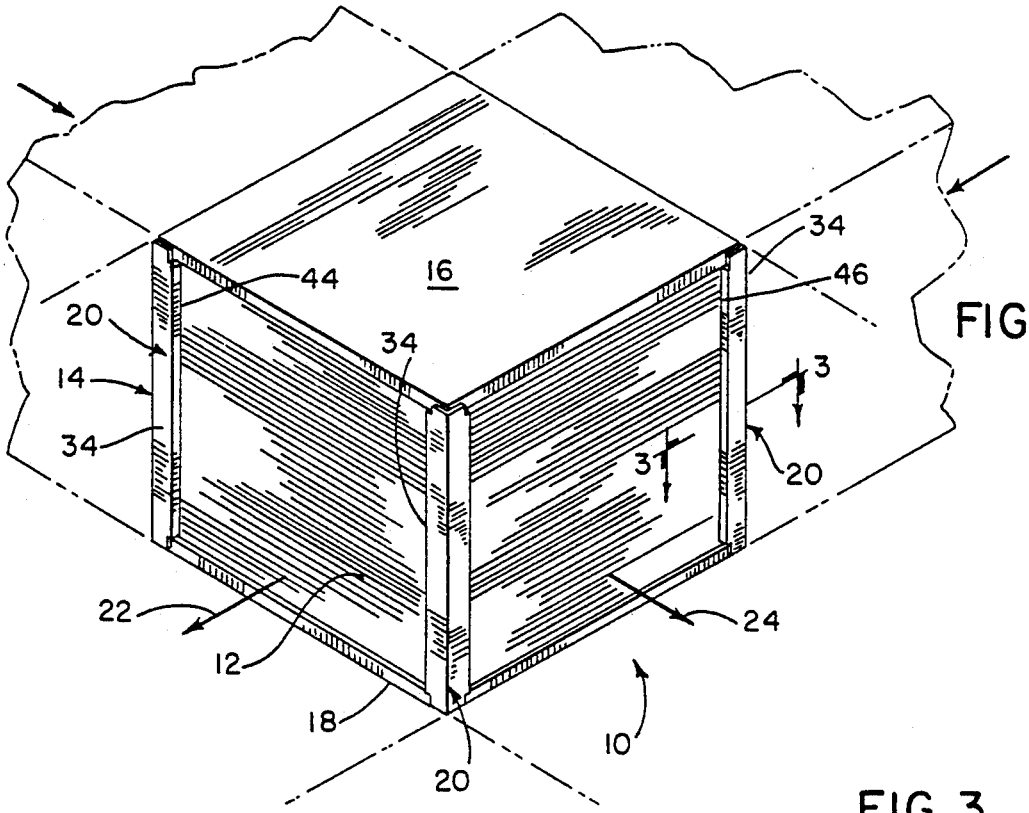
FIG. 1
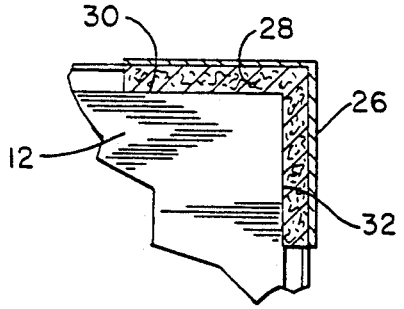
FIG. 2
PRIOR ART
FIG. 3
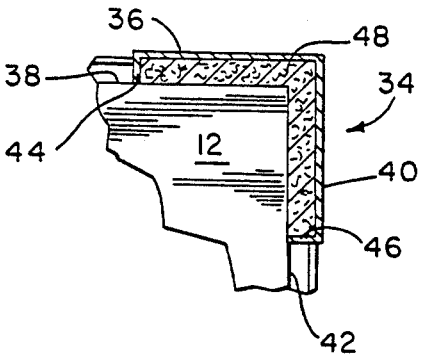
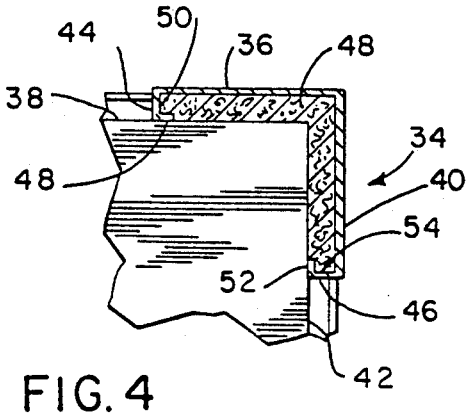
FIG. 4

HEAT EXCHANGER MEDIA FRAME

BACKGROUND OF THE INVENTION

The present invention relates to heat exchangers and more specifically to a corner frame construction for use on a heat exchanger.

It is known to manufacture a heat exchanger by stacking a plurality of substantially rectangular media layers within a framework so that the open edges of the media layers are exposed and define two substantially normal air flow paths. The air flowing along these two flow paths is of different temperatures and heat is exchanged between the two.

In order to increase the efficiency of the heat exchanger, it is desirable that all of the air be forced through the air paths defined by the media layers and that leakage around the media layers be kept to a minimum.

In the past, corner constructions for such heat exchangers were of the type shown in FIG. 2 in which an elongated L-shaped member was provided at the corner and flowable sealant was disposed between the L-shaped member and the edges of the media layers. Typically, the heat exchanger media is a paper-like material which will expand and contract as it is exposed to different temperatures and humidities. This would result in the edges of the media layer pulling on the sealant and separating it from the L-shaped member. This would create a leak path for the air around the media layers and reduce the efficiency of the heat exchanger.

It is an object of the present invention to provide a corner construction that enhances the bonding surface for the sealant so as to prevent media and sealant separation from the corner member.

SUMMARY OF THE INVENTION

An improved corner frame construction for a heat exchanger of the type in which a plurality of substantially rectangular heat exchanging media layers are disposed within a framework having top and bottom plates joined by four corner members includes an elongated L-shaped member having one end connected to the top plate and the other end connected to the bottom plate with a first leg of the L-shaped member extending substantially parallel to a first edge of the media layers and a second leg of the L-shaped member being perpendicular to said first leg and extending substantially parallel to a second edge of the media layers.

In accordance with one aspect of the invention, the elongated L-shaped member is provided with a first flange member that is connected to the first leg and extends the entire length of the first leg. The flange member extends inwardly toward an edge of the media layers.

In accordance with another aspect of the invention, a second flange member is connected to and extends the length of the second leg of the L-shaped member and extends inwardly toward a second edge of the media layers.

In accordance with yet another aspect of the invention, a layer of flowable sealant is disposed along the length of the L-shaped member and is in contact with both the first and second legs, the first and second media edges and both of said first and second flange members.

In accordance with still another aspect of the invention, the corner construction can be provided with a first lip that is connected to the first flange member and extends parallel to the first leg so as to define a sealant containing channel and a second lip connected to the second flange member and extending parallel to the second leg so as to define a second sealant containing channel.

BRIEF DESCRIPTION OF THE DRAWINGS

The drawings illustrate the best mode presently contemplated of carrying out the invention.

In the drawings:

FIG. 1 is a perspective view of a heat exchanger constructed according to the present invention;

FIG. 2 is a top cross-sectional view of the corner section of a prior art heat exchanger;

FIG. 3 is a sectional view along the line 3—3 of FIG. 1; and

FIG. 4 is a top cross-sectional view of an alternate embodiment for the heat exchanger of FIG. 1.

DETAILED DESCRIPTION OF THE PREFERRED EMBODIMENT

FIG. 1 illustrates a heat exchanger 10 of the type in which a plurality of substantially rectangular heat exchanging media layers are disposed within a framework 14 having a top plate 16 and a bottom plate 18 joined by four corner members 20. The layers of heat exchanging media 12 define two substantially normal air flow paths 22 and 24. The temperature of the air in flow path 22 is typically substantially different from that of the air in flow path 24 and since the two flow paths are separated by only a thin layer of paper-like material, heat is exchanged between the two flowing air masses.

In the past, the corner construction for a heat exchanger of this type was such as that shown in FIG. 2. In this corner construction, an elongated L-shaped member 26 was disposed at each of the four corners of the framework. A flowable sealant 28 was disposed between L-shaped member 26 and the two edges 30 and 32 of media layers 12. Since the paper-like media layers are subjected to varying temperatures and humidity levels, it is not unusual for them to expand and contract. During this expansion and construction, sealant 28 would be separated from L-shaped member 26 and an undesirable flow path would be created around the edges of the heat exchanger media. This would result in reduced efficiency for heat exchanger 10.

The present invention provides an improved corner construction consisting of an elongated L-shaped member 34 having one end connected to top plate 16 and the other end connected to bottom plate 18.

L-shaped member 34 is provided with a first leg 36 that extends substantially parallel to a first edge 38 of media layers 12 and a second leg 40 that is perpendicular to first leg 36 and extends substantially parallel to a second edge 42 of media layers 12.

A first flange member 44 is integral with first leg 36 and extends inwardly towards media edge 38. Similarly, second leg 40 is provided with a second flange 46 that extends inwardly toward media edge 42.

A flowable sealant 48 is disposed along the entire length of L-shaped member 34 and is in contact with both first and second legs 36 and 40, first and second media edges 38 and 42 and first and second flange members 44 and 46. Flange members 44 and 46 provide additional bonding surfaces for sealant 48 so that it is much more difficult for sealant 48 to separate from L-shaped member 34.

FIG. 4 illustrates an alternate embodiment of the invention in which a lip 48 is connected to first flange member 44 and extends parallel to first leg 36 so as to define a sealant containing channel 50. Similarly, second flange member 46 is provided with a lip 52 that extends parallel to second leg 40 and defines a sealant containing channel 54. This provides yet another bonding surface and also an obstruction to the movement of the sealant away from L-shaped member 34.

The present invention thus provides a corner construction for a heat exchanger in which multiple bonding surfaces are provided for the sealant so that the expansion and contraction of the heat exchanger media will not result in the separation of the sealant from the corner member. This eliminates undesirable leakage flow paths around the corner members and enhances the efficiency of the heat exchanger.

Various modes of carrying out the invention are contemplated as being within the scope of the following claims particularly pointing out and distinctly claiming the subject matter regarded as the invention.

I claim:

1. A corner frame construction for a heat exchanger of the type in which a plurality of substantially rectangular media layers are disposed within a framework having top and bottom plates joined by four corner members so that the edges of the media layers are exposed and define two substantially normal air flow paths, said corner construction comprising:

an elongated L-shaped member having one end connected to the top plate and the other end connected to the bottom plate, said L-shaped member having a first leg extending substantially parallel to a first edge of the media layers and a second leg perpendicular to said first leg and extending substantially parallel to a second edge of the media layers, a first flange member connected to and extending the length of said first leg, said first flange extending inwardly toward said first media layer edge, a second flange member connected to and extending the length of said second leg, said second flange extending inwardly toward said second media edge, and a layer of flowable sealant disposed along the length of said L-shaped member and in contact with both of said first and second legs, both of said first and second media edges and both of said first and second flange members.

2. The corner construction defined in claim 1 further comprising:

a first lip connected to said first flange member and extending parallel to said first leg so that said first leg, said first flange member and said first lip define a sealant containing channel, and a second lip connected to said second flange member and extending parallel to said second leg so that said second leg, said second flange member and said second lip define a sealant containing channel.

* * * * *